United States Patent [19]

Monne et al.

[11] Patent Number: 4,585,203

[45] Date of Patent: Apr. 29, 1986

[54] DEVICE FOR POSITIONING A MEMBER FACING EACH OF THE PERFORATIONS OF A PERFORATED PLATE IN ACCORDANCE WITH A GIVEN GRID

[75] Inventors: Maxime Monne, Paris; Andrzej Adamowski, Saint Maur, both of France

[73] Assignee: Intercontrole Societe Anonyme, Rungis, France

[21] Appl. No.: 361,865

[22] Filed: Mar. 25, 1982

[30] Foreign Application Priority Data

Apr. 8, 1981 [FR] France ..... 81 07063

[51] Int. Cl.[4] ..... F16M 13/00; D25J 15/00

[52] U.S. Cl. ..... 248/652; 248/649; 248/163.1; 165/11.2; 414/744 R; 414/749; 376/245

[58] Field of Search ..... 165/11 R, 11 A; 376/245, 249, 260, 269; 414/744 R, 744 A, 749, 750, 751; 248/163.1, 637, 646, 649, 651, 652

[56] References Cited

U.S. PATENT DOCUMENTS

| | | | |
|---|---|---|---|
| 3,889,820 | 6/1975 | Ranger | 414/750 |
| 3,913,752 | 10/1975 | Ward et al. | 414/750 |
| 4,004,698 | 1/1977 | Gebelin | 414/750 |
| 4,200,424 | 4/1980 | Gerkey et al. | 414/744 R |
| 4,205,939 | 6/1980 | Reyes | 414/744 R |
| 4,205,940 | 6/1980 | Golick | 414/744 R |
| 4,212,583 | 7/1980 | Gebelin | 414/750 |
| 4,231,696 | 11/1980 | Rieben | 414/749 |
| 4,298,054 | 11/1981 | Adamowski | 376/245 |
| 4,302,146 | 11/1981 | Finlayson et al. | 414/744 R |
| 4,303,368 | 12/1981 | Dent et al. | 414/750 |
| 4,438,805 | 3/1984 | Gugel | 165/11 A |
| 4,449,599 | 5/1984 | Creek | 165/11 A |

FOREIGN PATENT DOCUMENTS

| | | |
|---|---|---|
| 861842 | 8/1978 | Belgium . |
| 0004853 | 10/1979 | European Pat. Off. . |
| 2912658 | 10/1979 | Fed. Rep. of Germany . |

*Primary Examiner*—Deborah L. Kyle
*Assistant Examiner*—Richard Klein

[57] ABSTRACT

A device for positioning a member so as to face each of a plurality of perforations arranged in a given grid in a plate, especially for the inspection of the tubes of a steam generator in a nuclear power station. It comprises a body having at least two attachment members for fastening the device in the perforations. The device is rotatable around one or the other of these attachment members so as to displace it on the plate, and has a support carrying the member and pivotable with respect to the body in order to bring the member into a position facing several perforations without displacing the device.

5 Claims, 6 Drawing Figures

DEVICE FOR POSITIONING A MEMBER FACING EACH OF THE PERFORATIONS OF A PERFORATED PLATE IN ACCORDANCE WITH A GIVEN GRID

BACKGROUND OF THE INVENTION

The present invention relates to a device for positioning a member so that it faces each of the perforations of a perforated plate, in accordance with a given grid. More specifically the invention relates to a device making it possible to position a guide tube in such a way that it faces each of the tubes of a steam generator, such as those equipping nuclear power stations, in order to successively introduce into each of the said tubes a control device, such as an eddy current probe or sensor.

It is known that the tubes of steam generators used in nuclear power stations are exposed to particularly severe operating conditions making it necessary to periodically inspect these tubes in such a way that damaged tubes can be condemned by the sealing of each of their ends.

For this inspection to take place, it must be possible to introduce an automatic device into the water box or tank of the steam generator, said device being controlled from the outside. Thus, it is desirable to reduce to a maximum any human interventions, as a result of the highly contaminated and radioactive nature of such water tanks, and their small size. For the same reasons, the device must be as reliable as possible and must enable all the tubes to be inspected without any manual intervention being needed. Furthermore, for easily understandable economic reasons, the time necessary for the inspection of all the generator tubes must be as short as possible.

A positioning device is known, which comprises two perpendicular arms provided with members permitting their independent fastening into the ends of tubes and whereby they can move with respect to one another in three perpendicular directions, so that the guide tubes carried by the arms can be made to face all the steam generator tubes.

This device generally gives satisfactory results and makes it possible to carry out complete remote control in a relatively short time of all the steam generator tubes. However, as has been shown by the brief preceding description, it has the disadvantage of having to be equipped with several guide tubes in order to permit a complete scan or sweep of the tube plate. This means that the equipment enabling the introduction of the eddy current sensor has to be disconnected from one and connected to another of the guide tubes when the area to be reached makes this necessary. Thus, this operation involves manual intervention, which it would be desirable to eliminate for the reasons referred to hereinbefore. Moreover, in normal operation, each tube to be controlled necessitates the displacement of the complete device. This is obviously unsatisfactory, because it increases the inspection time. Finally, this prior art device necessitates a complete availability of the tubes for its attachment. In practice this is obviously not the case because certain tubes have already been sealed as a result of preceding inspections. Moreover, the operation of the aforementioned device is interfered with when the systems of perforations are not orthogonal.

BRIEF SUMMARY OF THE INVENTION

The problem of the present invention is to provide a device permitting an automatic, fast, reliable and complete inspection of all the tubes of a steam generator, whilst not having the disadvantages of the prior art device.

The present invention solves the aforementioned problem by means of a device for the positioning of a member so that it faces each of the perforations of a perforated plate in accordance with a given grid, comprising a body carrying at least two attachment members, means for displacing these members in a direction perpendicular to the plate and independently of one another, so that they can be introduced into or extracted from a facing perforation, means for fixing each of the attachment members in a facing perforation and means for the displacement of one of the members with respect to the other, wherein it also comprises at least one support carrying the said member at its free end and means for rotating this support with respect to the body in order to successively bring said member opposite to at least two different perforations without displacing the attachment members.

It is apparent that by permitting a member, such as a guide tube, to face several perforations without displacing the device with respect to the plate, it is possible to inspect several tubes without moving the device, which makes it possible to increase the inspection speed, whilst at the same time increasing accessibility to areas located on the edges of the tube plate.

According to a preferred feature of the invention, the means for displacing one of the members with respect to the other comprise means for pivoting the body and one of the attachment members about the other and vice versa. As a result of this displacement type, it is possible to use only one guide tube for providing access to all the perforations of a plate. Thus, all manual interventions, other than the fitting and removal of the device are eliminated.

According to a first constructional variant of the invention, the body comprises at least two parts, each of which carries an attachment member and means for varying the distance separating said attachment members as a function of the angular position of the body about at least one of said members, so that the other member can be brought into a facing position with respect to the perforations located at different distances from the perforation in which the first attachment member is fixed. According to this first variant the support is centered on one of the attachment members and the distance separating the guide tube from the said member is equal to the spacing of the perforations.

According to a second constructional variant of the invention, the support is centred on the end of an arm carried by the body at a point located in the centre of a mesh of the grid formed by the perforations. Means can be provided for pivoting the arm with respect to the body about an axis positioned equidistantly of the two rows of perforations defining the mesh.

BRIEF DESCRIPTION OF THE DRAWINGS

The invention is described in greater detail hereinafter relative to two non-limitative constructional variants of the invention and with reference to the attached drawings, wherein show.

DETAILED DESCRIPTION OF THE PREFERRED EMBODIMENTS

Figure 1:
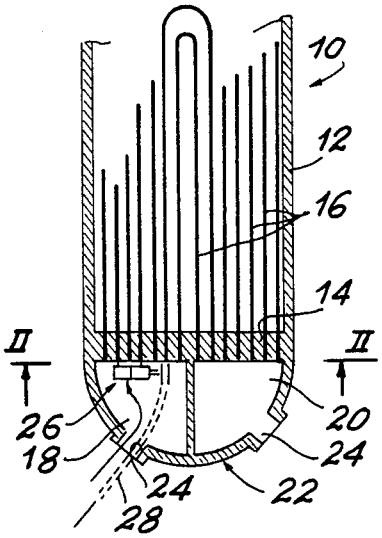
FIG. 1 a diagrammatic sectional view of the lower part of a steam generator with U-shaped tubes and where a device according to the invention has been introduced into one of the chambers of the water tank.

As is diagrammatically illustrated in FIG. 1, a steam generator 10 comprises a vertically axed outer cylindrical envelope 12 sealed at its lower end by a tube plate 14 having a large number of holes in which are fixed the U-shaped tubes 16, whose ends respectively issue into a supply chamber 18 and a discharge chamber 20 of a water box or tank 22 below tube plate 14. Device 26 according to the invention can be introduced, e.g. into chamber 18 by means of manholes 24. A bundle 28 of cables and lines connects device 26 to a not shown external control system insuring the remote positioning and displacement of the device. Bundle 28 also comprises a tube for the passage of an eddy current probe or sensor when device 26 is to be used for the inspection of tubes 16 by means of such a sensor.

Figure 2:
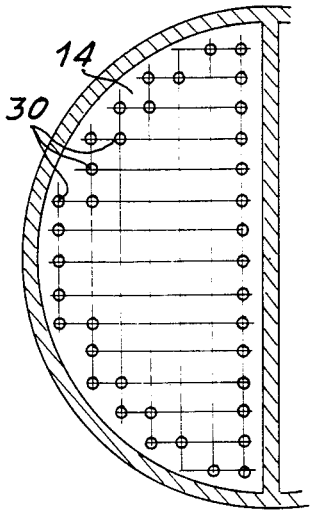
FIG. 2 a sectional view along line II—II of FIG. 1 showing the distribution in a square mesh grid of the ends of the tubes on the tube plate of one of the chambers of the water tank.

In exemplified manner FIG. 2 shows that the perforations 30 in tube plate 14 can define a square mesh grid. However, in not shown variants, the grid perforations 30 can have a different configuration and can in particular define meshes in the form of isosceles triangles.

According to the invention, device 26 is designed so as to permit a remote control of all the tubes 16 and also the performance thereof in a minimum amount of time. Moreover, it is designed so as to take account that certain tubes are sealed, which prevents the device from being supported on the ends of the corresponding tubes.

Figure 3:
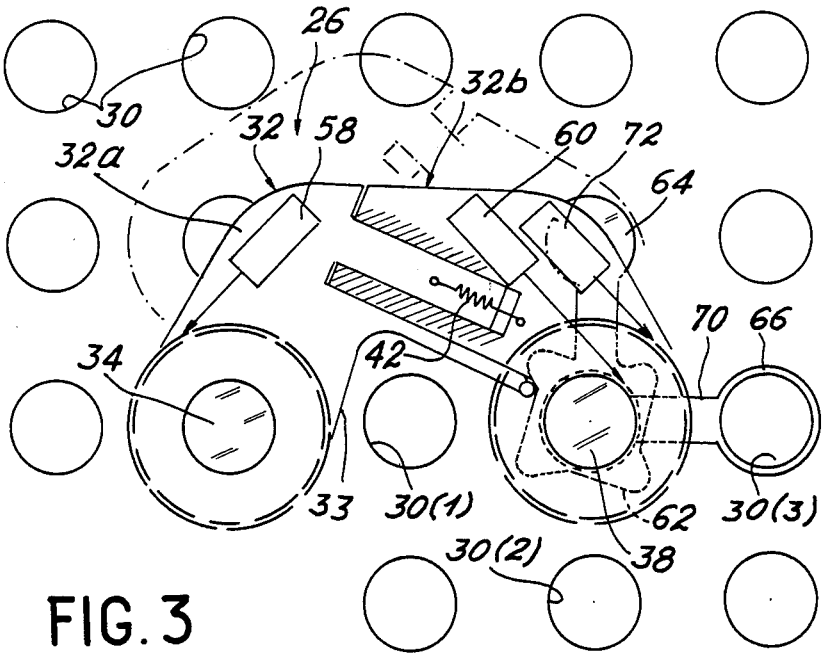
FIG. 3 a larger scale view illustrating a first embodiment of the device according to the invention shown from below with the part of the tube plate to which it is fixed.
Figure 4:
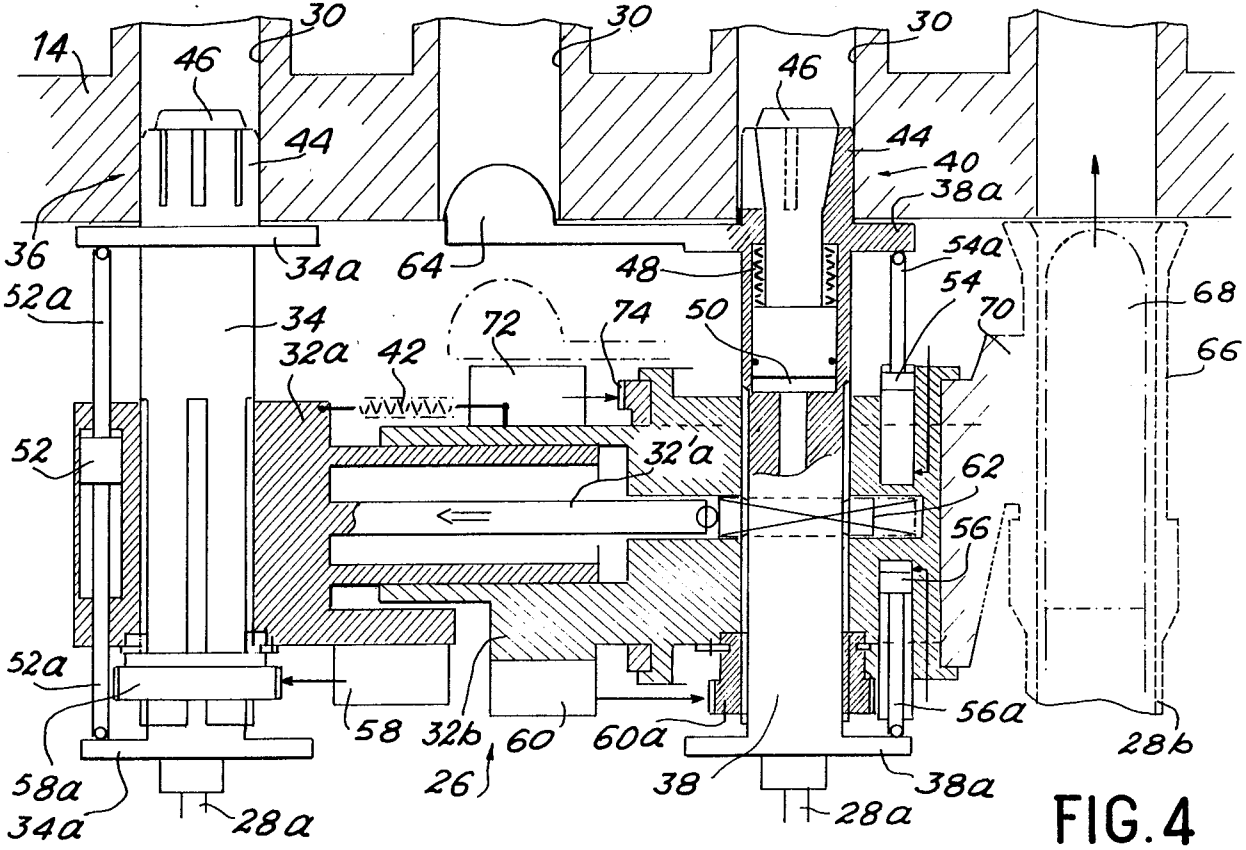
FIG. 4 a vertical sectional view of the device of FIG. 3 and the part of the tube plate to which it is fixed.

To take account of these various requirements, FIGS. 3 and 4 show that the device according to the invention comprises a body 32 constituted by an arm having two parts 32*a*, 32*b*. At its free end arm 32*a* carries a vertical spindle 34, which is terminated by an attachment member 36. In the same way, arm 32*b* carries at its opposite end a vertical spindle 38, which is also terminated by an attachment member 40, similar to member 36. For a reason which will become apparent hereinafter, parts 32*a* and 32*b* of the arm are fitted telescopically and are normally moved towards one another by a spring 42 in such a way that in the variant of FIGS. 3 and 4, the distance separating spindles 34 and 38 is equal to twice the spacing of the grid formed by perforations 30. Thus, attachment members 36 and 40 can penetrate two perforations 30 located on one and the same line or row of the grid and which are separated by one perforations.

For example, in FIG. 4 attachment members 36 and 40 can comprise elastic parts 44 normally drawn against the walls of perforations 30 by a widened part 46 axially pulled by a spring 48. The slackening of one or other of the attachment members 36 and 40 can be independently controlled by the pressurizing of a chamber 50 initiating the axial displacement of widened part 46 towards the interior of the corresponding perforation 30. As shown in FIG. 4, the effect of this displacement is to move the widened portion of member 46 out of elastic member 44, thereby disengaging the latter from the wall of the corresponding perforation. Chamber 50 is pressurized by a line or pipe 28*a* of bundle 28 issuing at the opposite end of the corresponding spindle with respect to the attachment members 36 and 40. Pressurization can take place by means of a random fluid, such as air. In this configuration, in the case of a failure of the pressurization system, members 36 and 40 are automatically marked by springs 48.

According to another, not shown, variant, the configuration is reversed, i.e. the slackening of the attachment members 36 and 40 is controlled by springs, whereas the attachment is brought about by a pressurized fluid. A convenient variant of the preceding attachment system comprises fingers which can be inflated either mechanically or by air. In either case, in order to obviate a possible failure of the pressurized fluid source, the centre of gravity of the device is displaced with respect to the plane passing through spindles 34 and 38 so as to bring out an immediate tilting, leading to the wedging of members 36 and 40 in the corresponding perforations. Such a displacement can be obtained either by means of a weight, or by using an inwardly curved arm having a high density portion.

Device 26 according to the invention comprises means for independently engaging and disengaging each of the attachment members 36 and 40 with respect to the facing perforation 30 by displacing these members perpendicular to the tube plate 14.

For example, these means comprise a single action jack 52 located in portion 32*a* of the arm and which is supported by rods 52*a* on flanges 34*a* of cylinder 34 in order to control the displacement of attachment member 36. For controlling the displacement of member 40, it is either possible to use the same arrangement, or two separate jacks 54 and 56 located in portion 32*b* of the arm and which are respectively supported by rods 54*a* and 56*a* on flanges 38*a* formed on cylinder 38 of either side of the arm.

As a result of this arrangement, it is readily apparent that if the attachment members 36 are slackened, the use of jack 52 makes it possible to disengage the member from the facing perforation 30. In the same way, if attachment member 40 is slackened, jacks 54 and 56 make it possible to disengage the parts 44 and 46 from the facing perforation.

Bearing in mind what has been stated hereinbefore, the displacement of device 26 on the grid formed by perforations 30 is brought about by means permitting the alternate pivoting of the complete device either about spindle 34, with member 36 attached in perforation 30, or about spindle 38 following the attachment of member 40. To facilitate the pivoting operations, rods 52*a*, 54*a* and 56*a* of the jacks cooperate with flanges 34*a* and 38*a* by rollers or any similar means.

In the constructional variant shown in FIGS. 3 and 4, the pivoting means comprise electric motors 58 and 60 respectively carried by portions 32*a* and 32*b* of the arm and controlling the endless screw rotation diagrammatically represented by the arrows in FIGS. 3 and 4. These endless or worm screws mesh on pinions 58*a* and 60*a* respectively. Pinion 58*a* is mounted on spindle 34, is rotated by the latter, but is immobilized in translation with respect to portion 32*a* of the arm. In the same way, pinion 60*a* is fitted to spindle 38 and rotated by the latter, but is immobilized in translation with respect to portion 32*b* of the arm.

As a result of these characteristics, it is clear that after the slackening of attachment member 40 and the disengagement thereof by the use of jacks 54 and 56, it is possible to rotate the device about spindle 34 by operating motor 58. Conversely, a rotation about spindle 38 is possible as a result of motor 60, following the slackening and disengagement of attachment member 36.

Obviously the travel controlled by using motors 58 and 60 is controlled in such a way as to permit a rotation of the device by an angle corresponding to attachment member 36, 40 being brought into a facing position with respect to another perforation. Thus, in the case of a square mesh grid of the type shown in FIGS. 2 and 3, the rotation is preferably by 90° or 180°. In the case of a grid with an isosceles triangle mesh, the rotation could be 60°, 120° or 180°.

As a result of what has been described hereinbefore, it is possible to displace device 26 within the chambers of the water tank. However, this displacement only permits the inspection of alternate tubes. Therefore, means are provided for displacing the device by one row in order to permit the inspection of all the other tubes. In the represented constructional variant, the device comprises a cam 62 carried by spindle 38 and rotating with the latter. The end of an extension 32'*a* of portion 32*a* of the arm bears on the cam. Like the ends of rods 52*a*, 54*a*, 56*a* of the jacks, extension 32'*a* carries a roller or similar device, which bears on shim 62 under the action of spring 42.

Obviously the configuration of cam 62 is chosen as a function of the network formed by the ends of the tubes. Thus, the cam enables the device to move in any direction of the network or grid. To ensure that the cam is always perfectly oriented, it is apparent from FIGS. 3 and 4 that cylinder 38 carries a finger 64, which engages in a perforation 30 adjacent to the perforation in which is located attachment member 40. Thus, cam 62 is always perfectly positioned in such a way that the operation of motor 60 on a travel predetermined as a function of the grid configuration makes it possible to move the device from the position shown in solid line form to that shown in broken line form in FIG. 3 by pivoting it about spindle 38. As a result of the cooperation between extension 32'*a* and shim 62, the distance separating spindles 34 and 38 increases so as to enable the attachment member 36 carried by spindle 34 to assume a position facing a perforation of the adjacent row. Obviously a similar construction could be provided for modifying the distance between spindles 34 and 38 during the pivoting of body 32 and spindle 38 about spindle 34.

According to the invention in order to make it possible to inspect several tubes without it being necessary to displace device 26, the latter carries a guide tube 66, which pivots about spindle 38. In per se known manner guide tube 66 is connected to a system for introducing a not shown, external eddy current probe or sensor by using a flexible tube 28*b* forming part of bundle 28. At 68 is diagrammatically shown an eddy current sensor at the point of being introduced into one of the tubes of the steam generator.

According to the invention, the guide tube 66 is carried by a support arm 70, in such a way that it faces the end of a tube adjacent to that in which is engaged the attachment member 40. The rotation of arm 70 and guide tube 66 about spindle 38 is controlled by a motor 72 carried by arm portion 32*b* and rotating an endless screw, diagrammatically represented by an arrow. The endless screw meshes on a pinion 74 centred on spindle 38 and fixed to arm 70. In the same way as for motors 58 and 60, the rotation controlled by motor 72 is determined as a function of the grid defined by the perforations 30. Thus, this rotation is 90° for a square mesh grid, as shown in FIGS. 2 and 3, or 60° for an isosceles triangle mesh grid.

In order to permit the inspection of three or even four adjacent tubes of perforation 30 in which is mounted attachment member 40, body 32 possibly has an inwardly curved shape defining a recess 33 freeing the perforation located between attachment members 36 and 40. Thus, it is apparent from FIG. 3 that it is possible in the position of device 26 shown in solid line form to inspect the tubes corresponding to perforations 30 (1), 30 (2) and 30 (3).

As a result of the pivoting movement around spindles 34 and 38 and the possibility of bringing spindle 34 into a facing position with respect to the adjacent perforation through the construction of body 32 in two different portions and the presence of cam 62, the aforementioned device by means of a single guide tube 66 permits the very rapid control of all the tubes of a steam generator, even if certain tubes are sealed and prevent the use of the corresponding perforation of tube plate 14.

Figure 5:
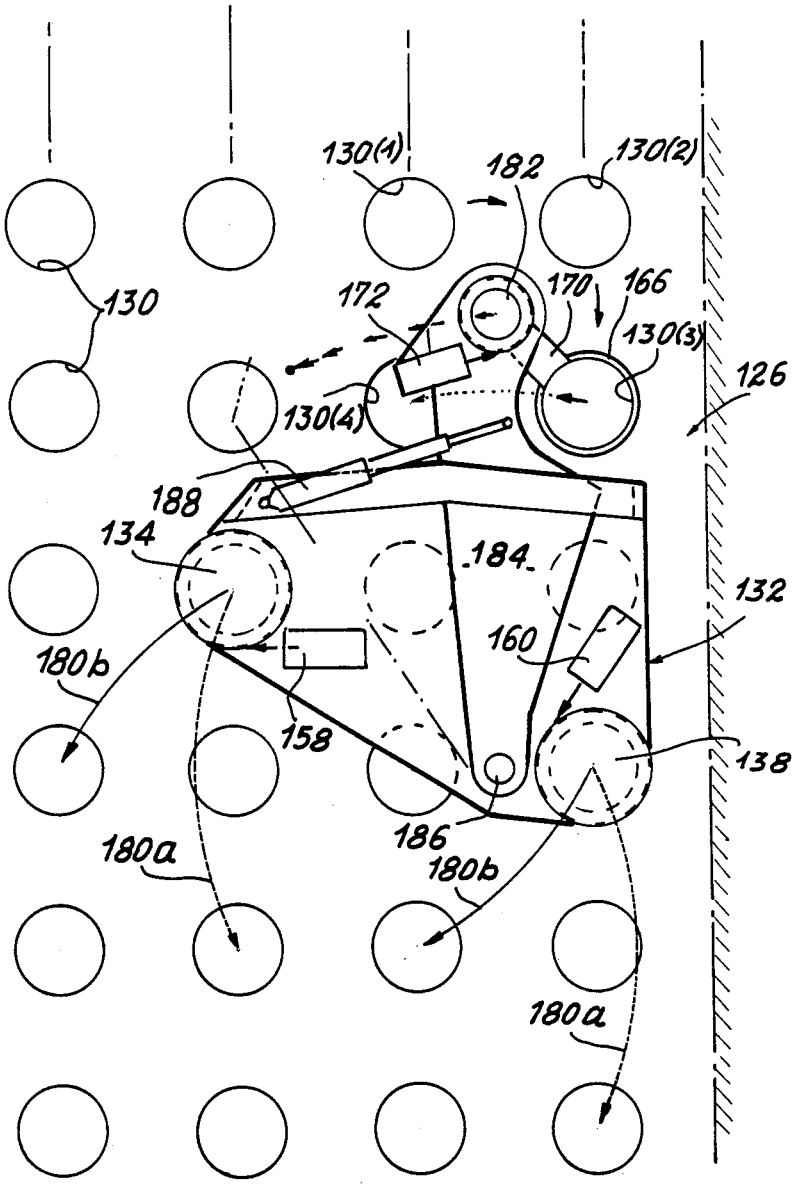
FIG. 5 a view from below comparable to FIG. 3 illustrating the second variant of the device according to the invention.

FIG. 5 diagrammatically shows a variant of the embodiment of the invention in which the same reference numerals, increased by 100, are used for designating the same members as those of the device described with reference to FIGS. 3 and 4.

Thus, on FIG. 5 device 126 comprises a body 132, which is in one piece and which rotates about two spindles 134, 138 by means comparable to those of the preceding embodiment and which in particular comprise motors 158, 160. Obviously each of the spindles 134, 138 carries an attachment member, similar to members 36 and 40 and each of these members is able to move independently of one another to permit the introduction or removal from the end of the facing tube. The arrangement of the spindles 134 and 138 in two separate rows of the grid formed by perforations 130 makes it possible either to displace device 126 parallel to the sides of the squares formed by these perforations, in the manner illustrated by arrows 180*a* in FIGS. 5 and 6, or to displace it diametrically with respect to the squares, is illustrated by arrows 180*b*.

In the variant of FIG. 5, guide tube 166 is fixed to a support arm 170, which pivots about a spindle 182 located in the centre of a square defined by perforations 130. Spindle 182 is itself mounted on an arm 184, which pivots by means of a spindle 186 on body 132. The pivoting of guide tube 166 and arm 170 about spindle 182 is controlled by a motor 172, similar to motor 72 of FIG. 4, and which for the same position of device 126, brings guide tube 166 into a facing position with respect to three perforations 130 (1), 130 (2) and 130 (3) in FIGS. 5 and 6. The articulation of arm 184 with respect to body 132 makes it possible to inspect the fourth perforation 130 (4) defining the square on which is centred spindle 182. More specifically, the pivoting of arm 184 under the action of a jack 188 makes it possible to move guide tube 166 from its position facing perforation 130 (3) of FIG. 5 to a position facing the adjacent perforation 130 (4) (as shown by dot-dash lines in FIG. 6). For this purpose, spindle 186 must be positioned equidistantly of the two adjacent rows in which are located perforations 130 (3) and 130 (4).

Figure 6:
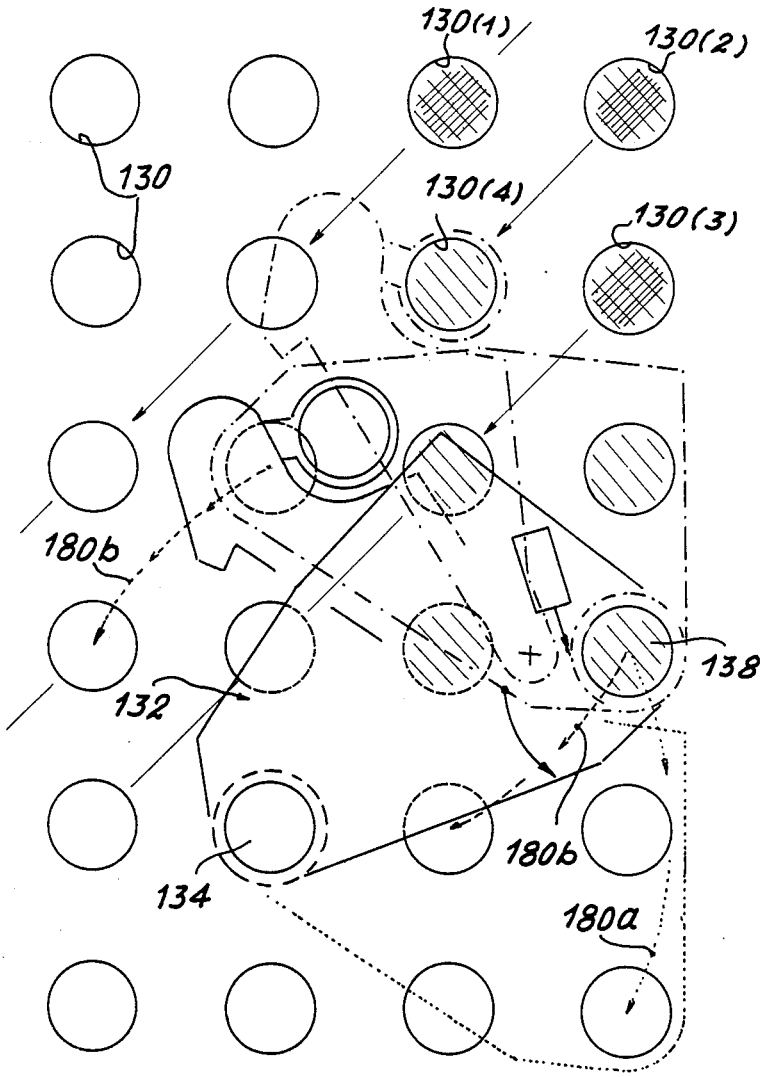
FIG. 6 diagrammatically the possibilities for the displacement and inspection of the tubes by means of the device of FIG. 5.

By means of the device of FIG. 5 and as illustrated diagrammatically in FIG. 6, it is possible to inspect all the tubes of a steam generator either by moving device 126 parallel to the sides of the squares defined by the perforations, which involves the use of the pivoting of lever 184 about spindle 186, or by carrying out a displacement of device 126 along the diagonals of the square defined by the grid, it then being unnecessary to use the pivoting of lever 184. However, the lever is still necessary in the latter case for reaching perforations which would not otherwise be accessible.

The invention is obviously not limited to the embodiments described in an exemplified manner hereinbefore and in fact covers all variants. It is obvious that the devices described hereinbefore are associated with any programmed or unprogrammed control and servocontrol means permitting the regulation and setting of all the movements.

We claim:

1. A device for positioning a member so that it faces each of a plurality of perforations in a plate, comprising: a body carrying at least two attachment members, means for displacing said attachment members in a direction perpendicular to a perforated plate and independently of one another, so that said attachment members can be selectively introduced into and extracted from any one of a plurality of perforations arranged in said plate in a given grid, means for fixing each of said attachment members in a facing perforation, means for displacing one of said members with respect to the other in a direction parallel to said plate, said body comprising at least two portions, each carrying one of said attachment members, said displacing means comprising means for pivoting said body about each of the attachment members, at least one support carrying another member to be positioned at its free end, and means for rotating said at least one support with respect to said body in order to successively bring said another member opposite to at least two different perforations of said plate without displacing said attachment members, said support being centered on one of said attachment members, and the distance between said another member and said one attachment member being equal to the spacing of the perforations from each other.

2. A device according to claim 1, wherein said displacing means further comprises means for varying the distance between said attachment members as a function of the angular position of the body about at least one of said attachment members, so as to position the other attachment member in such a way that it faces perforations located in any position or direction of the grid.

3. A device according to claim 1, wherein the distance normally separating said attachment members from each other is equal to at least twice the spacing of the perforations from each other, and said body has a recess enabling said another member to be brought into a facing position with respect to the perforation located between said attachment members.

4. A device according to claim 2, wherein the distance normally separating said attachment members from each other is equal to at least twice the spacing of the perforations from each other, and said body has a recess enabling said another member to be brought into a facing position with respect to the perforation located between said attachment members.

5. A device according to claim 1, wherein the center of gravity of the device is displaced relative to the plane joining the axes of said attachment members, so as to automatically wedge said members in the perforations if said attachment members fall.

* * * * *